US006772779B1

(12) United States Patent
Pearcy

(10) Patent No.: US 6,772,779 B1
(45) **Date of Patent: *Aug. 10, 2004**

(54) TENT WITH STORAGE RECEPTACLE

(75) Inventor: Larry E Pearcy, Wildwood, MO (US)

(73) Assignee: American Recreation Products, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/241,817

(22) Filed: Sep. 11, 2002

Related U.S. Application Data

(63) Continuation of application No. 09/767,277, filed on Jan. 23, 2001, now Pat. No. 6,450,186.

(51) Int. Cl.[7] ..... E04D 13/08
(52) U.S. Cl. ..... 135/96; 135/120.1
(58) Field of Search ..... 135/120.2, 115, 135/117, 119, 95, 96, 97, 120.1, 120.3; 396/590, 591, 592

(56) References Cited

U.S. PATENT DOCUMENTS

| | | | | |
|---|---|---|---|---|
| 513,841 A | | 1/1894 | Tolmie | |
| 2,543,597 A | | 2/1951 | Peery | |
| 3,463,540 A | | 8/1969 | Carr | |
| 3,586,013 A | | 6/1971 | Gladden | |
| D232,850 S | | 9/1974 | Bloyd | |
| 4,079,956 A | | 3/1978 | Headington, Jr. | |
| 4,731,627 A | * | 3/1988 | Chisholm | 396/592 |
| 4,802,500 A | | 2/1989 | Davis et al. | |
| 4,815,490 A | | 3/1989 | Söderström | |
| 4,872,470 A | | 10/1989 | Hayashida et al. | |
| 4,974,621 A | | 12/1990 | Lerma | |
| 5,019,849 A | * | 5/1991 | Harrison | 396/592 |
| D328,308 S | * | 7/1992 | Harrison | D16/237 |
| 5,222,513 A | | 6/1993 | Hilliard | |
| 5,240,021 A | | 8/1993 | Snodgrass | |
| 5,394,897 A | | 3/1995 | Ritchey et al. | |
| D384,125 S | | 9/1997 | Griffin | |
| 5,901,727 A | | 5/1999 | Kramer et al. | |

* cited by examiner

*Primary Examiner*—James O. Hansen
(74) *Attorney, Agent, or Firm*—Senniger, Powers, Leavitt & Roedel

(57) ABSTRACT

A tent includes a shell and poles for supporting the shell in erected configuration enclosing a space. The shell includes a receptacle having an access aperture and a mouth. The interior of the receptacle is accessible from outside the tent through one of the access aperture and the mouth and is accessible from inside the shell through the other of the access aperture and the mouth.

26 Claims, 4 Drawing Sheets

TENT WITH STORAGE RECEPTACLE

CROSS REFERENCE TO RELATED APPLICATIONS

This application is a continuation of U.S. Ser. No. 09/767,277, filed Jan. 23, 2001, now U.S. Pat. No. 6,450,186 which is incorporated herein by reference.

BACKGROUND OF THE INVENTION

The present invention relates generally to tents, and more particularly to a tent having a storage receptacle therein.

It is known to include a storage receptacle attached to a tent shell for storing camping gear, such as tent stakes and other small items. Storage receptacles in prior art tents typically comprise a piece of fabric sewn to the tent wall to form a pocket located inside the tent. Such pockets have limited utility because they do not allow for convenient access to the contents of the pocket from outside the tent. Thus, the user must open the tent door and enter the tent in order to place an item in the pocket.

Additionally, prior art storage pockets typically extend inward from the tent wall so that each pocket and its contents reduce the living space inside the tent. Such pockets are typically sized relatively small since pockets of larger size significantly reduce the living space. These relatively small pockets cannot hold larger gear, such as shoes, and therefore have limited utility.

SUMMARY OF THE INVENTION

Among the several objects of the present invention may be noted the provision of a tent including storage space capable of being sized to store gear of substantial size such as shoes; the provision of such a tent having a storage space which does not reduce living space within the tent; the provision of such a tent having storage space which is easy to access from inside and outside the tent; and the provision of such a tent which is economical to fabricate.

Briefly, apparatus of this invention is a tent comprising a shell and poles for supporting the shell in erected configuration enclosing a space. The shell includes a receptacle having an access aperture and a mouth. The interior of the receptacle is accessible from outside the tent through one of the access aperture and the mouth and is accessible from inside the shell through the other of the access aperture and the mouth.

In another aspect of the invention, the tent comprises a shell and poles for supporting the shell in erected configuration enclosing a space. The shell includes a doorway for entrance to and egress from said space. The shell has an opening therein disposed adjacent the doorway. A bag has an open mouth secured to the shell around the opening in the shell and is made of pliable material such that the bag is eversible. A mat is secured to the shell and is positioned outside the space adjacent the doorway and the bag. The bag has an access aperture with a closure therefor for being opened for access to the interior of the bag and closed for closing the aperture. The bag has an exterior position on the outside of the shell and is manipulable through the opening with attendant eversion to an interior position inside the shell in the space.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
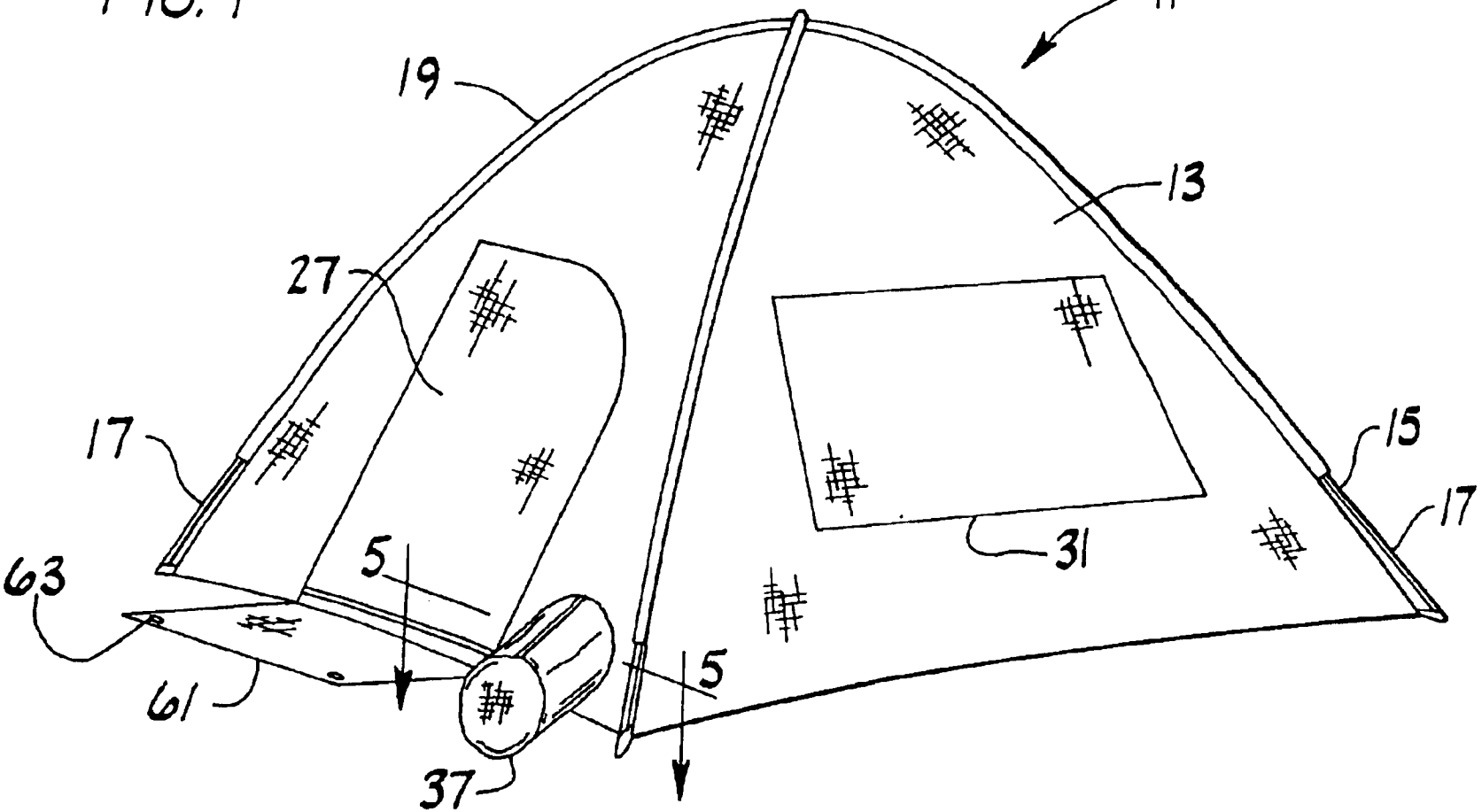
FIG. 1 is a perspective view of a tent of the present invention.
Figure 2:
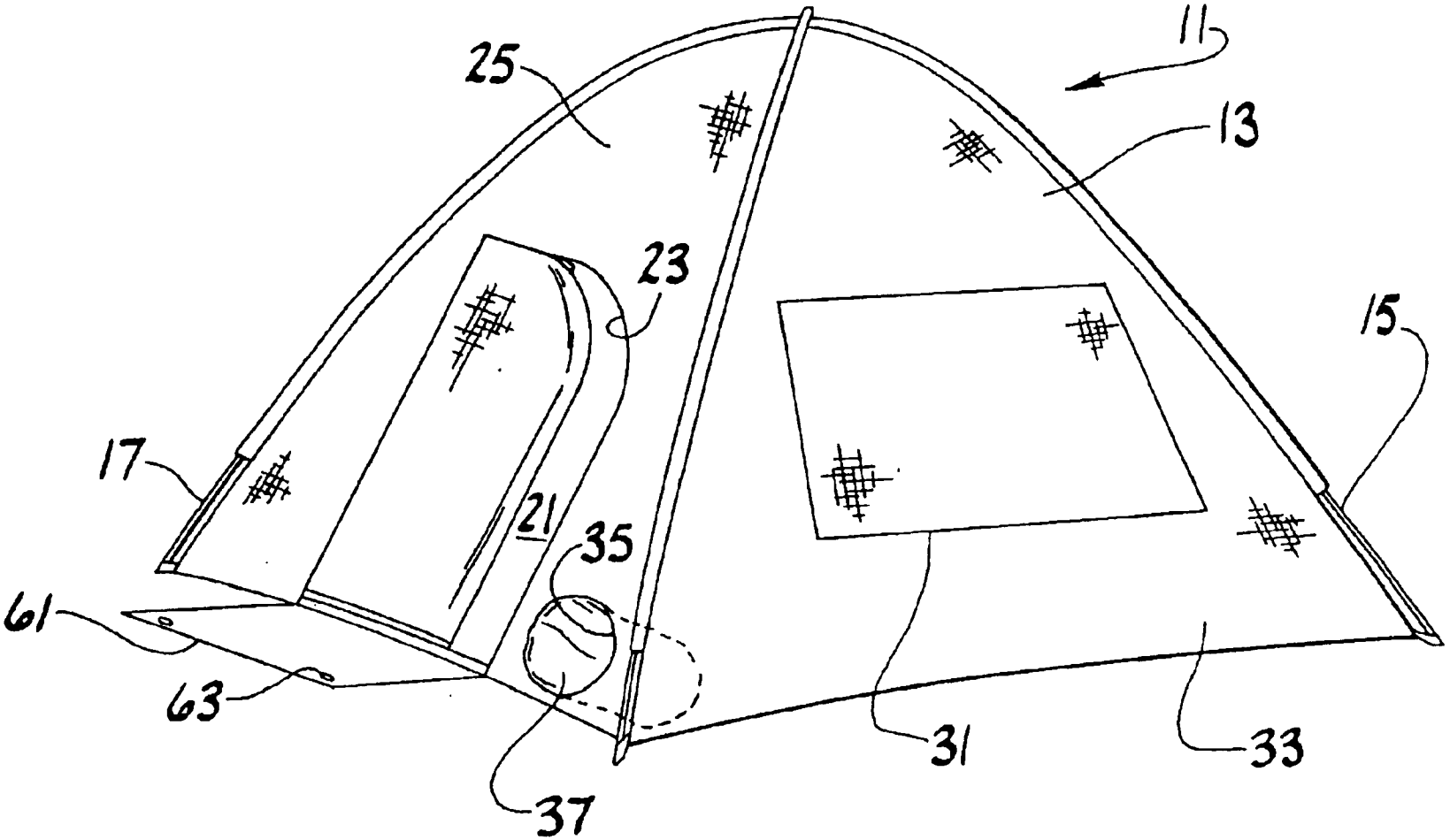
FIG. 2 is a perspective view similar to FIG. 1 except showing the bag of the invention in an interior position.

Referring now to the drawings and in particular to FIGS. 1 and 2, a tent of the present invention is designated in its entirety by the reference numeral 11. The dome-type tent comprises a flexible fabric shell 13 supported by a conventional collapsible frame 15 including two resilient poles 17 bent into an arched configuration when erected. In such configuration, the poles 17 are suitably secured to the shell 13, as by being positioned in sleeves 19 attached to the shell. Other means of securing the poles to the shell 13 are also contemplated. In the erected configuration, the shell 13 encloses a living space 21 which can be entered and exited through a doorway 23 provided in a front wall 25 of the shell. The shell 13 includes a door 27 secured to the shell by a slide fastener at the edge of the doorway 23. A window 31 may be provided in a side wall 33 of the shell 13 as shown.

Figure 4:
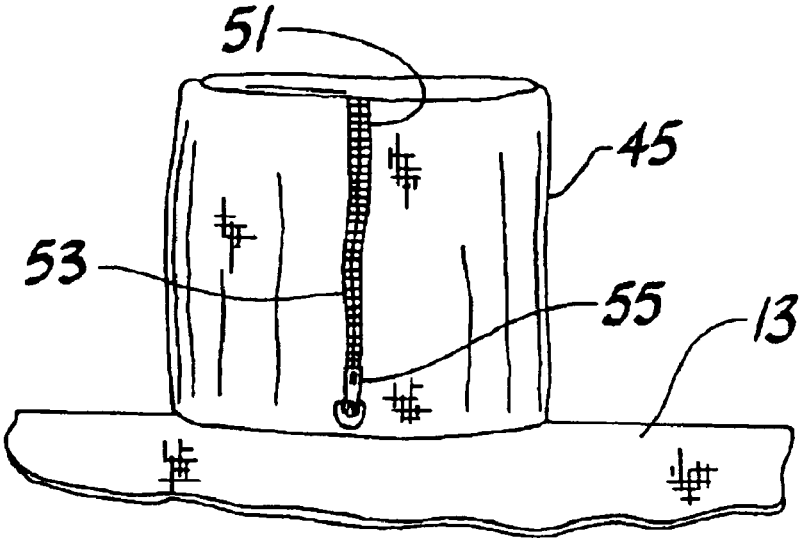
FIG. 4 is a top view of an inside portion of the tent shell showing the bag in an interior position.
Figure 5:
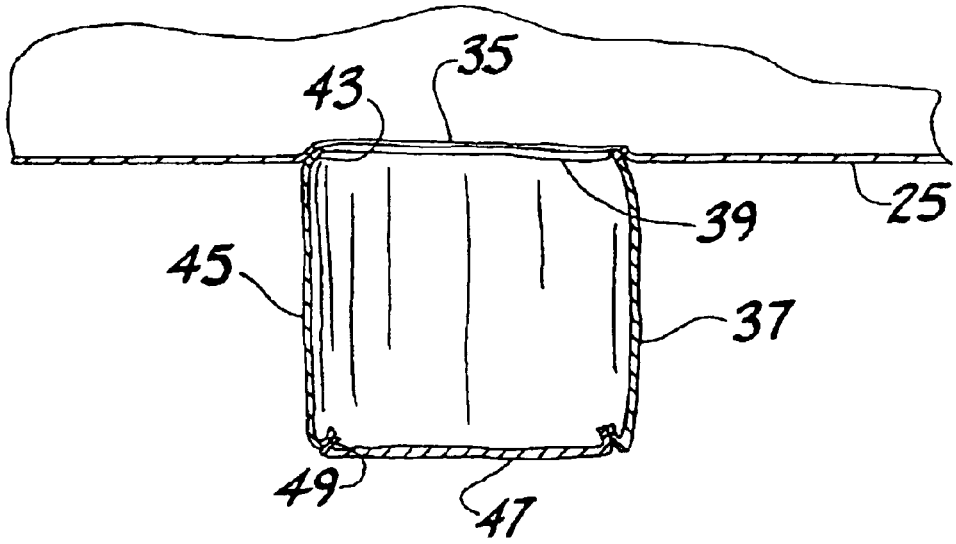
FIG. 5 is a sectional view taken along lines 5—5 of FIG. 1.

Referring to FIGS. 2 and 5, the shell 13 has an opening 35 in its front wall 25 adjacent the doorway 23. An open-mouthed bag 37 (broadly, receptacle) has its mouth end 39 secured to the shell 13 around the opening 35 in the shell such that the bag preferably closes the opening in the shell. The mouth end 39 of the bag 37 is suitably attached to the shell 13 around the opening at a sewn seam 43. Preferably, the bag 37 substantially seals the opening 35 in the shell 13 to inhibit entry of water and debris through the opening. However, it is contemplated that the bag 37 be secured to the shell 13 at the opening 35 such that it does not seal the opening 35. The bag 37 is preferably made of pliable, flaccid material such as nylon, polyester, canvas, polyethylene, or PVC and, being made of such material, is eversible. The bag 37 has an exterior position on the outside of the shell 13 (FIGS. 1, 3) and is manipulable through the opening 35 with attendant eversion to an interior position (FIGS. 2 and 4) inside the shell in the living space. The bag 37 comprises a generally cylindrical portion 45 attached at its closed end opposite the mouth end to a circular panel 47 at a sewn seam 49 to thereby close the bag (FIG. 5). The sewn seams 43, 49 are preferably made to substantially seal the bag 37 and thereby inhibit entry of water and debris. The seams 43, 49 preferably comprise two parallel rows of stitching to aid in sealing the bag 37. The bag is preferably sized between about 14 to 18 inches in diameter and between about 14 to 18 inches in length, though it is contemplated that the bag size may fall outside these ranges.

When the bag 37 is in the exterior position shown in FIG. 1, the bag is suitably manipulated through the opening 35 to the interior position by emptying the bag of any contents and then pushing (from the outside of the tent 11) or pulling (from the inside of the tent) the bag by hand through the opening. The bag 37 is likewise manipulated through the opening 35 to move it from the interior position to the exterior position.

Figure 3:
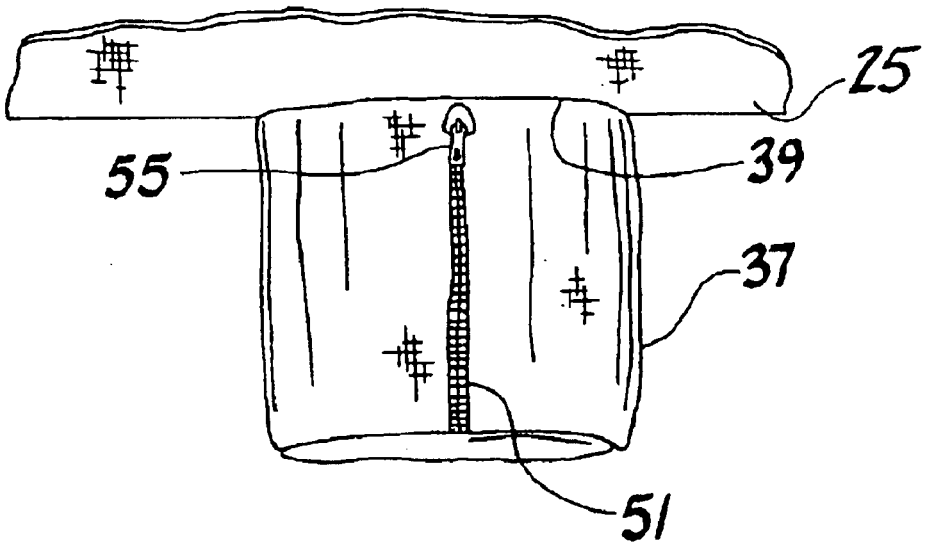
FIG. 3 is a top view of an outside portion of the tent shell showing the bag in an exterior position.

As shown in FIGS. 3 and 4, the bag 37 has a lengthwise slit 51 (broadly, access aperture) closable by suitable means, such as a slide fastener 53. Preferably, the slide fastener includes two pulls 55 for opening and closing the bag 37; one pull on either side of the fastener so that the bag is openable and closable by use of the fastener in both the exterior and interior positions. Thus, it the bag 37 is in the interior position, the user can open and close the bag from inside the tent 11 by pulling on one of the fastener pulls 55, and can access the inside of the bag through the opening 35 from outside the tent. If the bag 37 is in the exterior position, the user can open and close the bag from outside the tent 11 by pulling on one of the fastener pulls 55 and can access the inside of the bag through the opening 35 from inside the tent. It is contemplated that the closure for the slit may also be of another type, for example, velcro, or snaps.

Figure 6:
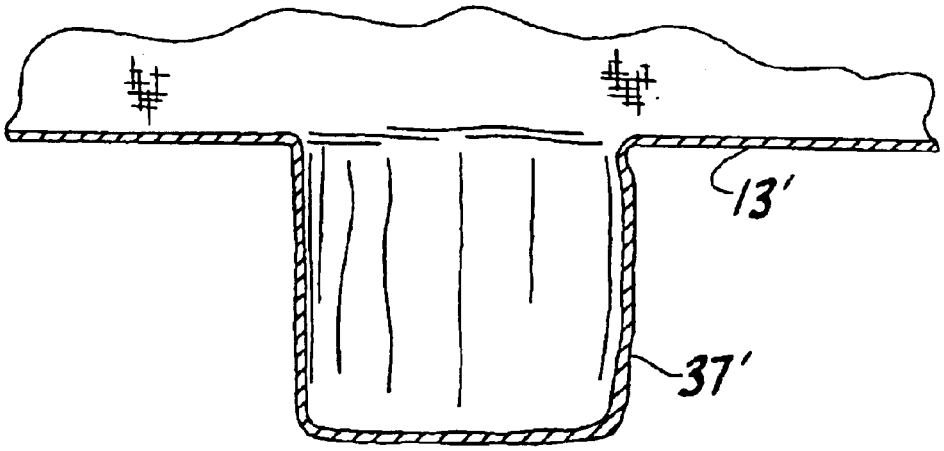
FIG. 6 is a sectional view similar to FIG. 5 but showing an alternate embodiment.

Referring to FIG. 6, in an alternate embodiment, the bag 37' is formed integrally as one piece with the shell 13' so that there is no seam between the bag and shell and so that the shell may be more easily manufactured. In this embodiment, the shell 13 may be made of plastic or other suitable material.

Referring again to FIGS. 1 and 2, a mat 61 is fixedly secured to the shell 13 and positioned outside the living space 21 adjacent the doorway 23. Preferably, the mat 61 is positioned immediately below the door 27 and extends outward away from the door. The mat may be held in position by stakes received through reinforced holes 63 in the mat. The mat 61 is preferably sized such that it extends substantially the full width of the door 27 and extends outward from the door a distance of about two to three feet, though these sizes are not required. A user may thereby remove his shoes while standing on the mat 61 and place the shoes inside the bag 37 either through the opening 35 if the bag is in the interior position or through the slit 51 if the bag is in the exterior position.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising:

a shell, poles for supporting the shell in erected configuration enclosing a space, said shell including a doorway for entrance to and egress from said space, a door for closing the doorway, a mat disposed outside the space generally below the doorway, and a receptacle having an access aperture and a mouth, an interior of the receptacle being accessible from inside the space through one of the access aperture and the mouth and being accessible from outside the space through the other of the access aperture and the mouth, the receptacle being disposed on the shell such that a user can access the interior of the receptacle while on the mat, and a closure for closing the access aperture.

2. A tent as set forth in claim 1 wherein the receptacle is disposed adjacent the doorway and adjacent a lower peripheral edge of the tent.

3. A tent as set forth in claim 1 wherein the receptacle is disposed between the door and one of the poles of the tent.

4. A tent as set forth in claim 1 wherein the space enclosed by the shell includes a living space, and wherein the receptacle is exterior of the living space.

5. A tent as set forth in claim 4 wherein the receptacle is adapted to project generally forward of the doorway.

6. A tent as set forth in claim 1 wherein said receptacle is sized and shaped for storage of shoes.

7. A tent as set forth in claim 6 wherein said receptacle is about 14 to 18 inches in length.

8. A tent as set forth in claim 6 wherein said receptacle defines a volume of between about 1.2 and about 2.6 cubic feet.

9. A tent as set forth in claim 1 wherein the receptacle is sewn to the shell to substantially seal an opening in the shell.

10. A tent comprising:

a shell, poles for supporting the shell in erected configuration enclosing a space, said shell including a doorway for entrance to and egress from said space, a door for closing the doorway, and a receptacle disposed adjacent the doorway and having an access aperture and a mouth, an interior of the receptacle being accessible from outside the space through one of the access aperture and the mouth and being accessible from inside the space through the other of the access aperture and the mouth, and means for closing the access aperture.

11. A tent as set forth in claim 10 wherein the receptacle is disposed adjacent a lower peripheral edge of the tent.

12. A tent as set forth in claim 10 wherein the receptacle is disposed between the door and one of the poles of the tent.

13. A tent as set forth in claim 10 wherein the space enclosed by the shell includes a living space, and wherein the receptacle is exterior of the living space and is adapted to project generally forward of the doorway.

14. A tent as set forth in claim 10 wherein said receptacle is sized and shaped for storage of shoes.

15. A tent as set forth in claim 14 wherein said receptacle is about 14 to 18 inches in length.

16. A tent as set forth in claim 14 wherein said receptacle defines a volume of between about 1.2 and about 2.6 cubic feet.

17. A tent as set forth in claim 10 wherein the receptacle is sewn to the shell to substantially seal an opening in the shell.

18. A tent comprising:

a shell, poles for supporting the shell in erected configuration enclosing a space, said shell including a doorway for entrance to and egress from said space, a door for closing the doorway, and a receptacle having an access aperture and a mouth, the receptacle being disposed adjacent a base of the tent between the door and one of the poles, an interior of the receptacle being accessible from outside the space through one of the access aperture and the mouth and being accessible from inside the space through the other of the access aperture and the mouth, and means for closing the access aperture.

19. A tent as set forth in claim 18 wherein the space enclosed by the shell includes a living space, and wherein the receptacle is exterior of the living space and is adapted to project generally forward of the doorway.

20. A tent as set forth in claim 18 wherein said receptacle is sized and shaped for storage of shoes.

21. A tent as set forth in claim 20 wherein said receptacle is about 14 to 18 inches in length.

22. A tent as set forth in claim 20 wherein said receptacle defines a volume of between about 1.2 and about 2.6 cubic feet.

23. A tent comprising:

a shell, poles for supporting the shell in erected configuration enclosing a space, said shell including a doorway for entrance to and egress from said space, a door for closing the doorway, and a receptacle having an access aperture and a mouth, an interior of the receptacle being sized and shaped for storage of shoes, the interior being accessible from outside the space through one of the access aperture and the mouth and being accessible from inside the space through the other of the access aperture and the mouth, and a closure for closing the access aperture.

24. A tent as set forth in claim 23 wherein said receptacle is about 14 to 18 inches in length.

25. A tent as set forth in claim 23 wherein said receptacle defines a volume of between about 1.2 and about 2.6 cubic feet.

26. A tent as set forth in claim 23 the space enclosed by the shell includes a living space, wherein the receptacle is exterior of the living space and is to project generally forward of the doorway.

* * * * *